US010449757B2

(12) United States Patent
Bangel

(10) Patent No.: US 10,449,757 B2
(45) **Date of Patent: *Oct. 22, 2019**

(54) PROCESSING UNIT AND LABEL PRINTING MACHINE HAVING THE PROCESSING UNIT

(71) Applicant: GALLUS DRUCKMASCHINEN GMBH, Langgoens-Oberkleen (DE)

(72) Inventor: Dieter Bangel, Huettenberg (DE)

(73) Assignee: Gallus Druckmaschinen GmbH, Langgoens-Oberkleen (DE)

( * ) Notice: Subject to any disclaimer, the term of this patent is extended or adjusted under 35 U.S.C. 154(b) by 146 days.

This patent is subject to a terminal disclaimer.

(21) Appl. No.: 15/685,724

(22) Filed: Aug. 24, 2017

(65) Prior Publication Data

US 2018/0056642 A1 Mar. 1, 2018

(30) Foreign Application Priority Data

Aug. 25, 2016 (DE) ..... 10 2016 215 988

(51) Int. Cl.
*B41F 13/18* (2006.01)
*B41F 17/00* (2006.01)
(Continued)

(52) U.S. Cl.
CPC ..... *B41F 13/18* (2013.01); *B41F 13/20* (2013.01); *B41F 13/21* (2013.01); *B41F 13/24* (2013.01); *B41F 13/34* (2013.01); *B41F 17/00* (2013.01)

(58) Field of Classification Search
CPC ..... B41F 13/008; B41F 13/30; B41F 13/32; B41F 3/54; B41F 13/20; B41F 13/34;
(Continued)

(56) References Cited

U.S. PATENT DOCUMENTS 4,530,282 A 7/1985 Schulz
4,810,179 A * 3/1989 Cavanagh ..... B29C 43/24 425/141

(Continued)

FOREIGN PATENT DOCUMENTS

DE 3317746 A1 11/1984
DE 102005015046 A1 10/2006

(Continued)

*Primary Examiner* — David H Banh
(74) *Attorney, Agent, or Firm* — Laurence A. Greenberg; Werner H. Stemer; Ralph E. Locher

(57) ABSTRACT

A processing unit for rotational processing includes at least two processing cylinders and a machine frame. A first processing cylinder is movably mounted in the machine frame, a second processing cylinder is stationarily mounted in the machine frame and a pair of support members is provided for each respective processing cylinder. A respective support member of the second processing cylinder has a solid joint, a manipulator and an annular segment attached to the solid joint and contacting one support member of the first processing cylinder. A solid joint is linearly displaceable by the manipulator and an annular segment is linearly displaceable therewith. A gap dimension between the processing cylinders can therefore be adjusted in a simple, accurate manner with precise repeatability. A label printing machine having the processing unit is also provided.

12 Claims, 6 Drawing Sheets

(51) Int. Cl.

| | |
|---|---|
| ***B41F 13/20*** | (2006.01) |
| ***B41F 13/21*** | (2006.01) |
| ***B41F 13/24*** | (2006.01) |
| ***B41F 13/34*** | (2006.01) |

(58) Field of Classification Search
CPC ..... B41P 2217/11; B41P 2200/12; B41P 2200/30; B41K 1/363
See application file for complete search history.

(56) References Cited

U.S. PATENT DOCUMENTS 5,099,760 A * 3/1992 Schneider ..... B23Q 1/68 101/351.4
5,423,254 A * 6/1995 Kimura ..... B41F 5/20 101/217
5,433,897 A * 7/1995 Kanome ..... B29C 43/222 264/1.33
6,457,407 B2 * 10/2002 Leib ..... B41F 13/30 101/145
7,754,116 B2 * 7/2010 Mizunuma ..... B29C 43/245 264/40.5
8,499,691 B2 * 8/2013 Bangel ..... B41F 11/00 101/145
2001/0003954 A1 * 6/2001 Leib ..... B41F 13/30 101/145
2002/0020314 A1 * 2/2002 Jader ..... B41F 13/32 101/216
2004/0045463 A1 * 3/2004 Pertile ..... B41F 31/027 101/350.6
2007/0045885 A1 * 3/2007 Mizunuma ..... B29C 43/245 264/40.1
2016/0185099 A1 * 6/2016 Verkuijlen ..... B41F 5/24 101/216
2016/0375679 A1 * 12/2016 Schmale ..... B41F 3/00 101/407.1
2017/0043570 A1 * 2/2017 Bastici ..... B41F 5/24
2017/0157966 A1 * 6/2017 Becker ..... B41M 1/04

FOREIGN PATENT DOCUMENTS

EP 2103429 A1 9/2009
WO 2012016758 A1 2/2012

* cited by examiner

PROCESSING UNIT AND LABEL PRINTING MACHINE HAVING THE PROCESSING UNIT

CROSS-REFERENCE TO RELATED APPLICATION

This application claims the benefit, under 35 U.S.C. § 119, of German Patent Application DE 10 2016 215 988.7, filed Aug. 25, 2016; the prior application is herewith incorporated by reference in its entirety.

BACKGROUND OF THE INVENTION

Field of the Invention

The invention relates to a processing unit for the rotational processing of a web-shaped or a sheet-shaped substrate, including at least two processing cylinders and a machine frame, in which a first processing cylinder is mounted so as to be movable in the machine frame, a second processing cylinder is mounted so as to be stationary in the machine frame, and each processing cylinder is assigned a pair of support members. The invention also relates to a label printing machine having the processing unit.

Printing units and punching units are used for label printing machines such as those described in European Patent EP 2 103 429 B1, corresponding to U.S. Pat. No. 8,499,691, for example. The printing units include at least three cylinders, specifically the inking roller, the printing roller and the impression roller. The rotational processing carried out therein causes ink to be applied to a substrate. The punching units include at least two cylinders, specifically the punching cylinder and the mating die cylinder. The rotational processing occurring therein causes the incorporation of punch and/or groove lines. In order for a gap, that is to say the spacing between the cylinders, to be adapted to the substrate to be processed and in order for the punching depth to be set, the gap has to be adjustable.

To that end, support members which can be configured as raceways, annular supports, and as so-called bearer rings, are used. Examples of adjustment installations are to be found in German Publication DE 10 2005 015 046 A1 and in International Publication WO 2012/016758 A1.

On one hand, the complicated and complex construction of adjustment installations of that type is disadvantageous. On the other hand, the precision of adjustment leaves much to be desired. That also results in poor precision in repeatability. That is to say that if the very same gap dimension as in the last order has to be chosen for a repeat order, an exact adjustment of that type will be difficult to carry out.

SUMMARY OF THE INVENTION

It is accordingly an object of the invention to provide a processing unit and a label printing machine having the processing unit, which overcome the hereinafore-mentioned disadvantages of the heretofore-known devices of this general type and in which a gap dimension between processing cylinders of the processing unit is adjustable in a simple, exact manner with precise repeatability.

With the foregoing and other objects in view there is provided, in accordance with the invention, a processing unit, for example a printing unit or a punching unit, for the rotational processing of a web-shaped or sheet-shaped substrate, comprising at least two processing cylinders and a machine frame. A first processing cylinder thereof is mounted so as to be movable in the machine frame, a second processing cylinder is mounted so as to be stationary in the machine frame and each processing cylinder is assigned one pair of support members. According to the invention, a respective support member of the second processing cylinder has a solid joint or all-solid joint, an annular segment attached to the latter, and a manipulator, wherein each annular segment contacts a respective one of the support members of the first processing cylinder. A respective solid joint is displaceable in a linear manner by using a respective manipulator, and a respective annular segment is also displaceable therewith in a linear manner. In order for such a displacing movement to be caused, a respective manipulator acts on the solid joint. The use of a solid joint of this type has the advantage that the latter is simple, cost-effective, adjustable in a highly precise manner, and is not sensitive to contamination.

It is particularly advantageous for a respective solid joint to have only one degree of freedom which is aligned along a linear axis. The solid joint herein can preferably be configured in such a manner that the solid joint has elements and/or tapers in the material which enable an elastic deformation of the solid joint and thus a movement in the direction of the linear axis.

In one advantageous refinement, a respective solid joint has at least one leaf spring as such an element, wherein the at least one leaf spring connects the body of the solid joint to the machine frame.

In one particularly advantageous and thus preferred refinement of the processing unit according to the invention, the manipulator is configured as a rotatable eccentric roller or helical roller that is fixedly attached to the frame and is rotatable in particular by motive power. It is advantageous for the manipulator to be in permanent contact with the solid joint in such a way that a rotating movement of the manipulator can be converted to a linear movement of the solid joint.

In one advantageous refinement of the processing unit, the body of the solid joint can be mounted on the machine frame, for example by using guide jaws that are mounted on the latter.

In one particularly advantageous and thus preferred refinement of the processing unit according to the invention, the support members of the first processing cylinder are embodied as raceways that are disposed axially to the cylinder and are mounted so as to be rotatable on the rotation axis of the cylinder. These raceways contact the annular segments of the support members of the second processing cylinder. Due to this construction, the gap dimension between the two processing cylinders can be established in a highly exact manner.

In one advantageous variant embodiment, the first processing cylinder has a tensioning mechanism, for example a pneumatic cylinder, for setting the relative position and the mutual compression of the processing cylinders. A bias between the processing cylinders can thus be generated.

In one potential embodiment, the annular segment of a respective support member is disposed on the body of the solid joint so as to be pivotable counter to a restoring force, for example a spring force, to which end a spring pack can be integrated in the solid joint.

With the objects of the invention in view, there is concomitantly provided a label printing machine, comprising at least one processing unit as described above, wherein in particular the first processing cylinder is embodied as a printing cylinder, the second processing cylinder is embodied as an impression cylinder, and a further stationary processing cylinder is embodied as an inking roller, in particular an anilox roller. The inking roller in this instance likewise has support members as described in detail above.

By contrast, however, if the processing unit has only two processing cylinders, the processing unit can be embodied as a punching unit, wherein the first processing cylinder is embodied as a punching cylinder and the second processing cylinder is embodied as a mating die cylinder. The same construction is also suitable for an embossing unit having an embossing cylinder and a mating embossing cylinder.

The invention described herein and the advantageous refinements of the invention described herein also represent advantageous refinements of the invention in combination with one another, to the extent that such combinations are expedient.

Other features which are considered as characteristic for the invention are set forth in the appended claims.

Although the invention is illustrated and described herein as embodied in a processing unit and a label printing machine having the processing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
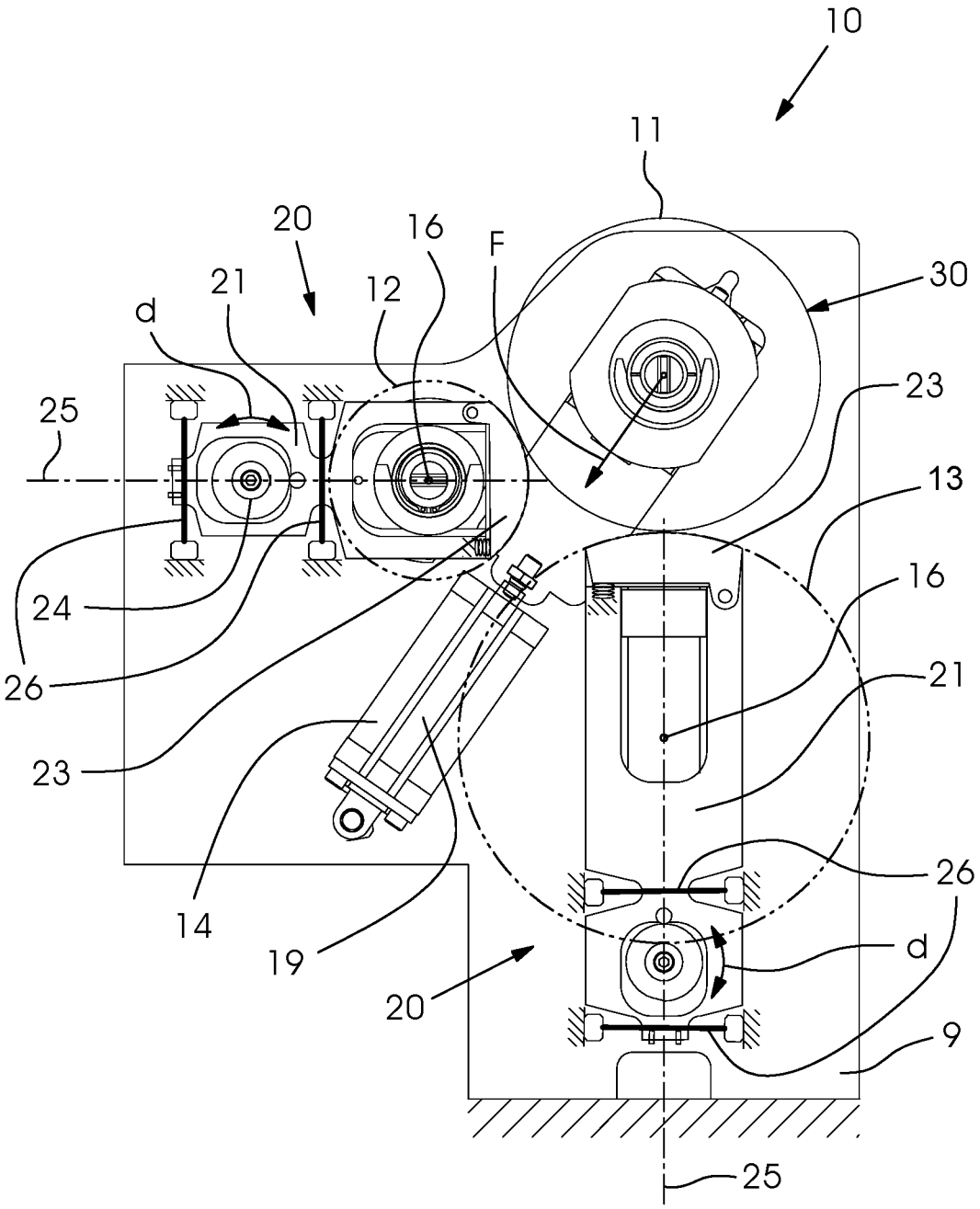
FIG. 1 is a diagrammatic, side-elevational view of a processing unit according to the invention.

Referring now to the figures of the drawings in detail and first, particularly, to FIG. 1 thereof, there is seen a processing unit 10 having a first cylinder 11, a second cylinder 12 and a third cylinder 13. The three cylinders are mounted in a machine frame 9. The processing unit 10 in the illustrated exemplary embodiment is a flexographic printing unit, wherein the first cylinder 11 is embodied as the plate cylinder, the second cylinder 12 is embodied as the anilox cylinder having a rotation axis 16, and the third cylinder 13 is embodied as the impression cylinder. The second cylinder 12 and the third cylinder 13 are mounted so as to be stationary in the machine frame 9. By contrast, the first cylinder 11 is mounted on a swing arm 19 so as to be movable in the machine frame 9. A pneumatic cylinder 14, which forms a tensioning mechanism, is attached to the swing arm 19. The pneumatic cylinder 14 uses a force F as a bias force and serves for setting and pressing the first cylinder 11 relative to and onto the two stationary cylinders 12, 13. Support members 30, which are embodied as raceways, are disposed on the rotation axis of the first cylinder 11, so as to be axial to the first cylinder 11 and on either side thereof. These raceways contact support members 20 of the second and of the third cylinders. These support members 20 each are embodied so as to be displaceable in a linear manner along a respective linear axis 25.

Figure 2:
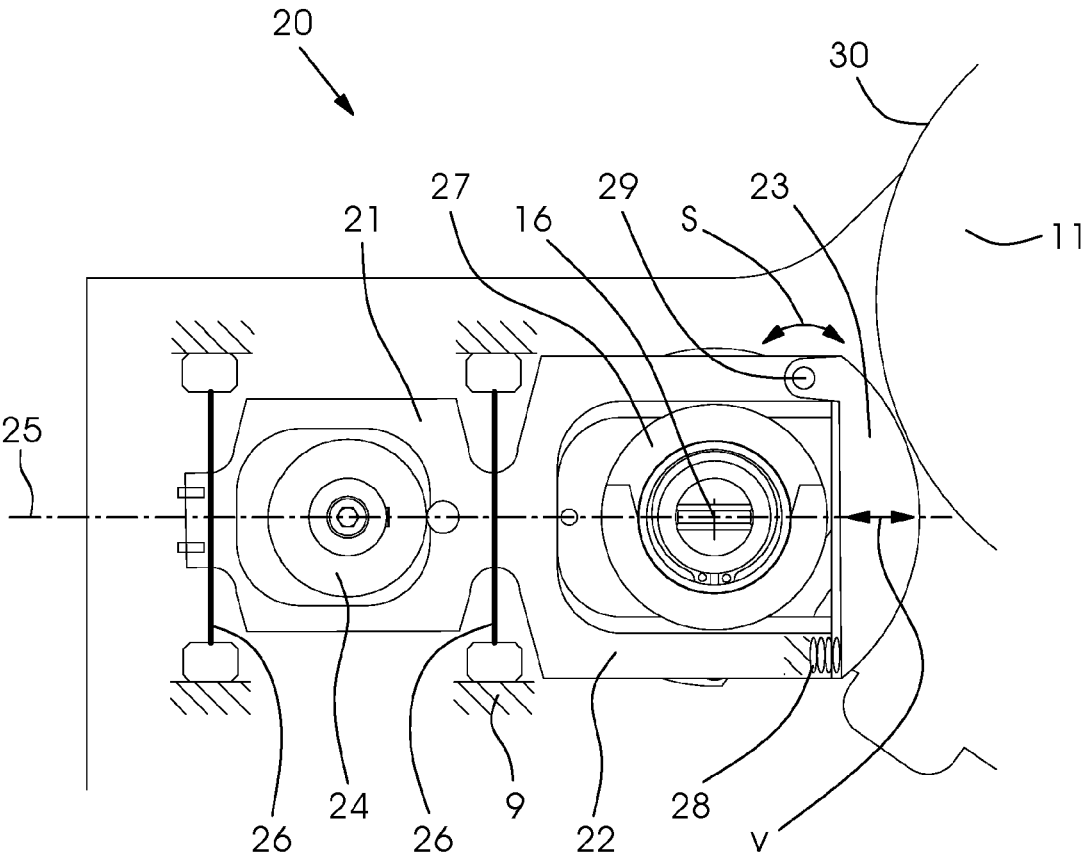
FIG. 2 is an enlarged, detailed view of a support member of FIG. 1.

The construction of a respective support member 20 is shown in detail in the illustration of FIG. 2. The support member 20 has a solid joint or all-solid joint 21, an annular segment 23 and a manipulator 24. The solid joint 21 has a body 22 and leaf springs 26. The body 22 of the solid joint 21 is mounted so as to be displaceable on guide elements 27 that are fixed to the machine frame 9. The body 22 is fastened to the machine frame 9 by using the leaf springs 26. The annular segment 23 is attached to the body 22 of the solid joint 21 on that side of the support member 20 that faces the first cylinder 11 so as to be pivotable (double arrow s) about a pivot point 29. A spring pack 28, which causes a restoring force of the annular segment 23, is sunk into the body 22. If the spacing between the first cylinder 11 and the second cylinder 12 is now to be adjusted, the annular segment 23 is displaced in a linear manner, in such a way that an adjusting movement (double arrow v) is imparted which is aligned in the direction of the degree of freedom 25 of the solid joint 21. The annular segment 23, which is in contact with the support member 30 of the first cylinder 11, thus displaces the first cylinder by way of the support members 30. The displacement of the annular segment 23 herein is implemented in that the manipulator 24, which is configured as a helical disk in the illustrated exemplary embodiment, is rotated (rotating movement d). This rotating movement d is converted to a linear displacing movement of the body 22 of the solid joint 21. In other words, the adjusting movement v is generated by using an elastic deformation of the solid joint 21 by an external force acting on the solid joint 21.

Figure 3:
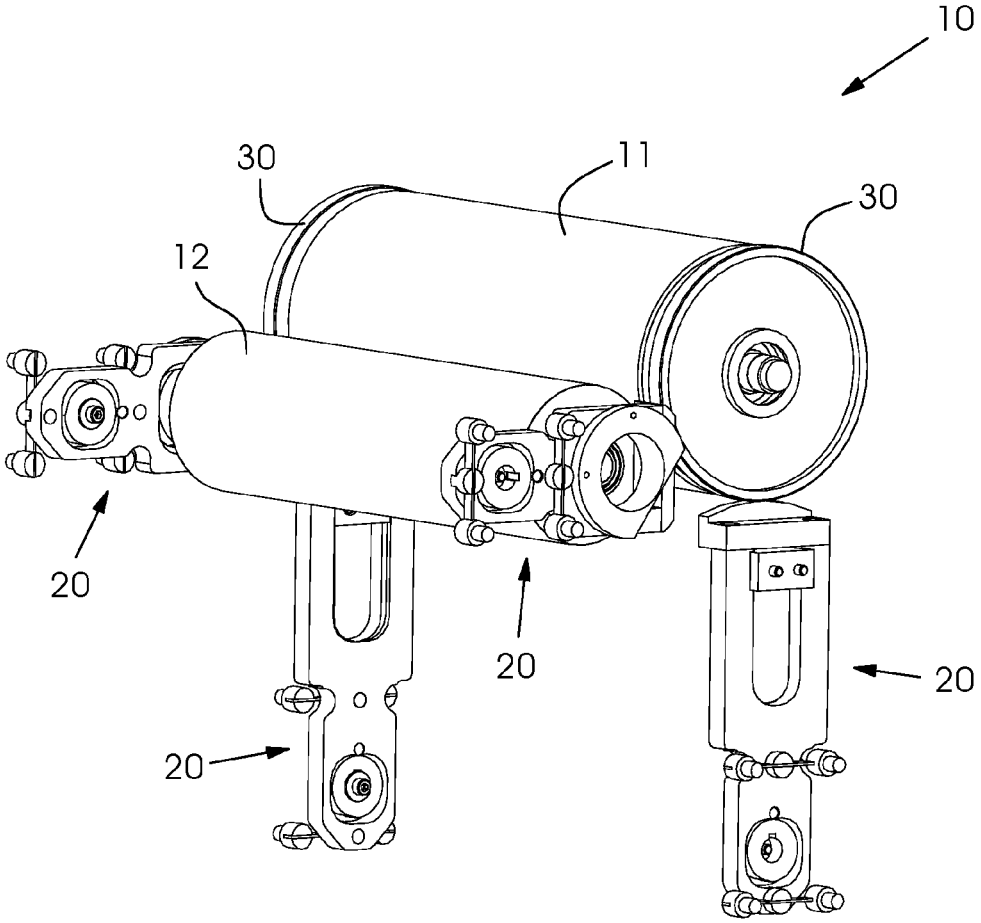
FIG. 3 is a perspective view of the processing unit of FIG. 1.

The configuration of the support members 20 and of the support members 30, in each case on either side of the cylinders 11, 12, 13 (drive side and operator side), can be derived from the three-dimensional illustration of FIG. 3. For the sake of improved clarity, the cylinder 13 is not illustrated. If the gap dimension between the cylinders 11, 12 or 11, 13, respectively, is not to be adjusted in a uniform manner, but the cylinders 11, 12 or 11, 13, respectively, are to be skewed instead, dissimilar rotating movements d are performed on the drive-side and operator-side manipulators 24, resulting in adjusting movements v of dissimilar size.

Figure 4:
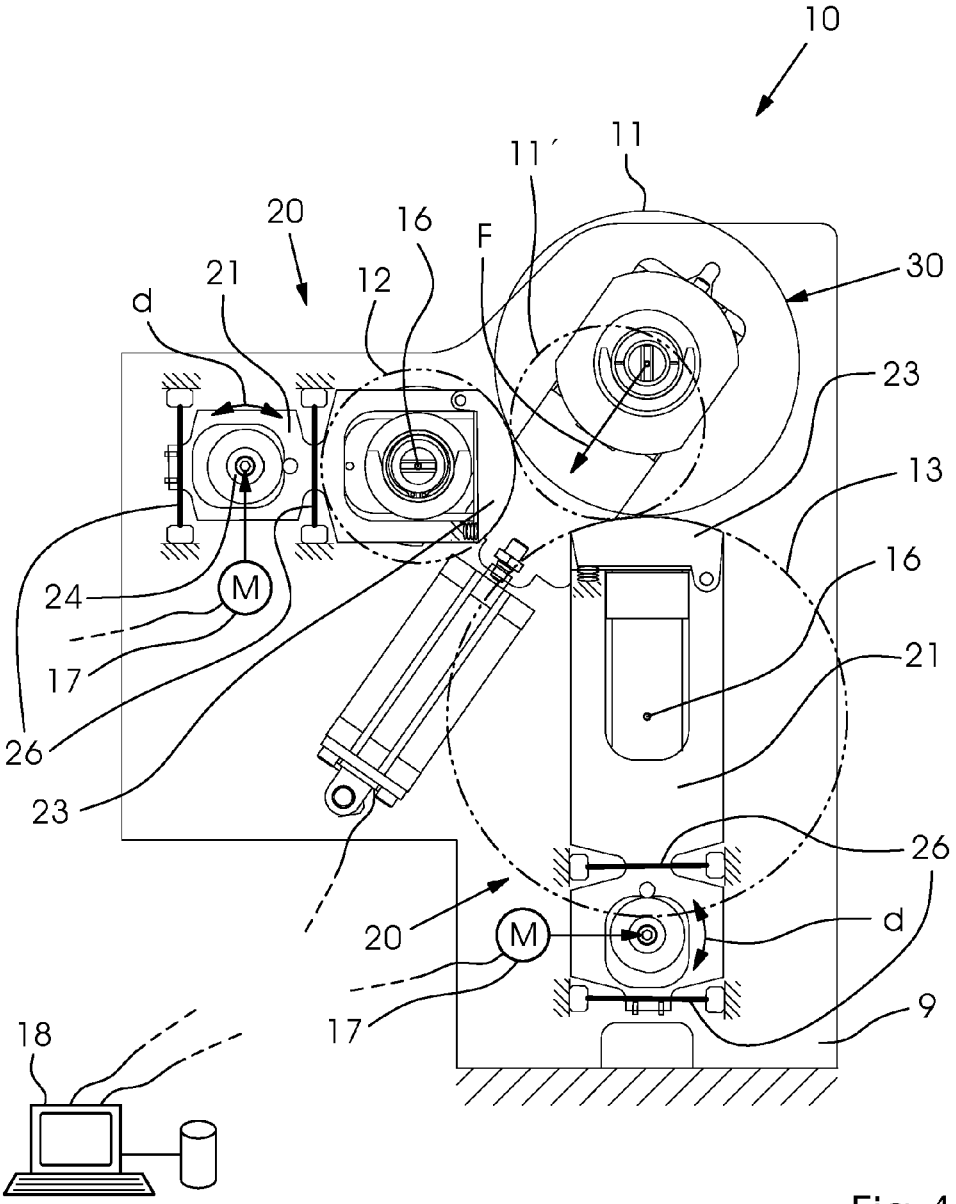
FIG. 4 is a view similar to FIG. 1 of an alternative embodiment of a processing unit.

The activation of the manipulators herein can be performed manually by the machine operator, or else by motive power. This second variant is illustrated in FIG. 4. Each manipulator 24 is connected to one respective motor 17 and is moved by the latter. In the illustrated exemplary embodiment, the motors 17 are in turn connected to a control installation 18 in terms of data transmission technology and are actuated by the latter. In the case of this motorized and automatic embodiment, dynamically assisted printing is also possible, that is to say an adaptation of the printing gap so as to depend on the machine speed.

In the case of an order changeover, for example when switching takes place from a first cylinder 11 to a first cylinder 11' having a smaller diameter, the pneumatic cylinder 14 is deactivated, and the bias force F between the cylinders 11, 12, 13 is canceled. The spring packs 28, which are integrated in the bodies 22 of the solid joints 21, by way of the spring force of the former, cause the annular segments 23 to be pivoted away from the respective body 22 of the solid joint 21 in such a way that the support members 30 of the first cylinder 11 are also raised. As a result, the first cylinder 11 is set apart from the two other cylinders 12, 13.

As an alternative to the embodiment of the manipulator 24 as a helical roller, the manipulator 24 could also be embodied as an eccentric roller or as a piezo actuator.

Figure 6:
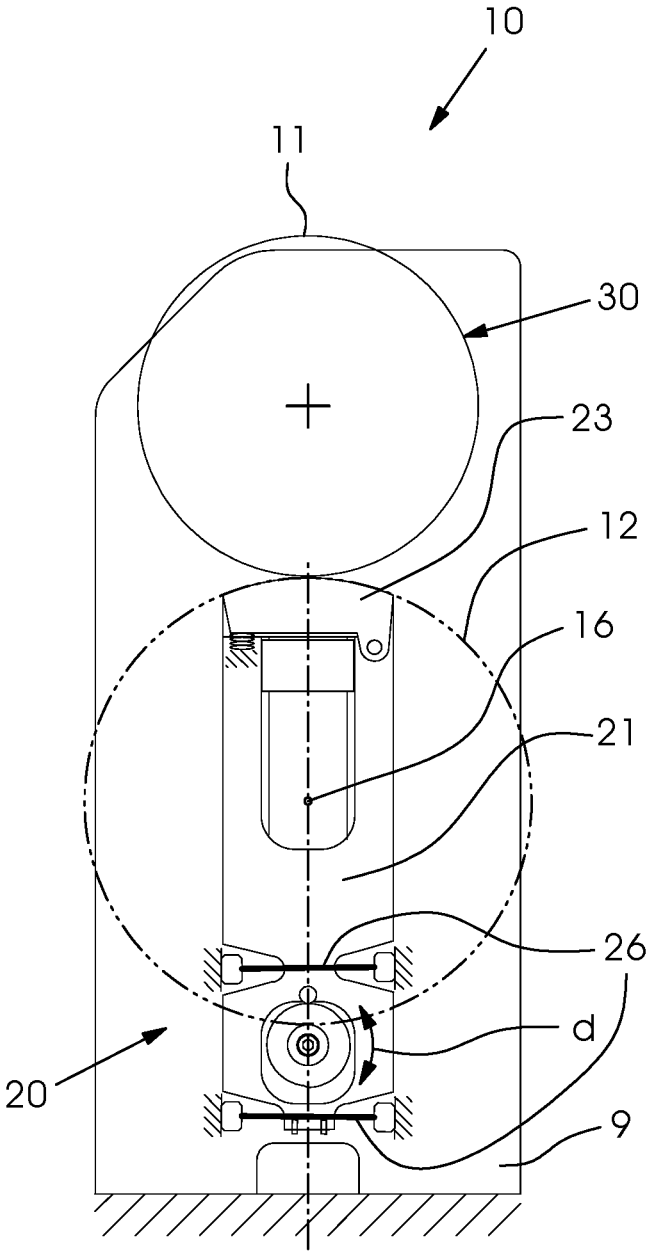
FIG. 6 is a side-elevational view of an alternative embodiment of a processing unit, having only two cylinders.

A processing unit 10 having a first cylinder 11 and having a second cylinder 12, both being mounted in the machine frame 9, is illustrated in FIG. 6. The processing unit 10 in the illustrated exemplary embodiment is a punching unit, wherein the first cylinder 11 is embodied as the punching cylinder, and the second cylinder 12 is embodied as the mating die cylinder. The second cylinder 12 is mounted so as to be stationary in the machine frame 9. By contrast, the first cylinder 11 uses a support member 20 having a solid joint 26 and is mounted so as to be movable in a guide (not illustrated in more detail) in the machine frame 9.

Figure 5:
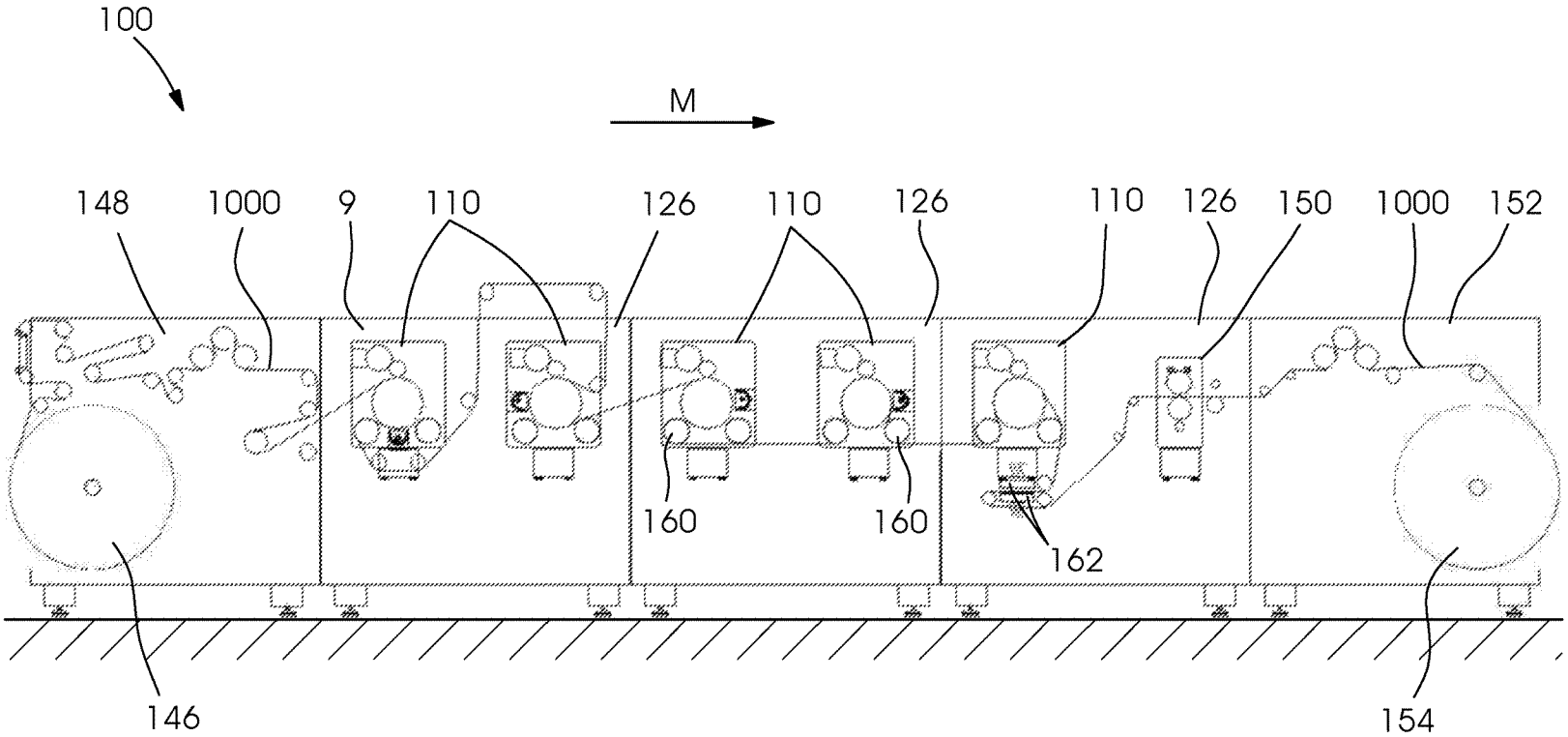
FIG. 5 is a longitudinal-sectional view of a label printing machine having a plurality of processing units.

An illustration of a preferred embodiment of a printing machine 100, more specifically a narrow-web label printing machine with a sequential construction, having printing units 110 that follow in the horizontal direction, is shown in FIG. 5. The label printing machine 100 serves for processing a substrate 1000 in the shape of a web. The substrate is unwound from a substrate roll 146 in a feed part 148 of the printing machine 100 and is guided along a path in a machine running direction M through the printing machine 100. The printing machine 100 can have a plurality of frame modules 126, with three frame modules 126 being presently illustrated in an exemplary manner. The frame modules 126 conjointly form the machine frame 9. In this embodiment, in each case two printing units 110, or one printing unit 110 and one processing unit 150, which is presently illustrated as a punching unit for punching labels from the web-shaped substrate 100, are received in each case on one respective frame module 126. The individual processing stations are followed by an outlet part 152 in which the finished products are wound onto a label roll 154. The feed part 148, the frame modules 126, and the outlet part 152 are respectively interconnected in a releasable or separable manner, resulting in a modular construction of the printing machine 100.

In the illustration of the individual printing units 110, which are presently shown as flexographic printing units, chamber doctor blades are also shown apart from the printing cylinders, the impression cylinders, and the inking rollers. The printing units 110 in the printing machine 100 furthermore have various drying installations. UV drying installations are assigned downstream of the impression cylinders on respective printing gap of the printing unit 110 in such a way that the printed substrate 1000 can be dried directly on the impression cylinder. The printing units 110 also have web guide rollers 160 for guiding the web-shaped substrate 1000. The fifth printing unit 110 in the embodiment shown has a hot air drying installation 162. Alternatively, a UV or an IR drying installation could also be employed in this case. A punching unit 150, which has a punching cylinder and a mating die cylinder as rotating tools, is disposed subsequent to the drying installation. An embossing unit, for example a hot-film embossing unit, can also be used additionally or alternatively, respectively, to the punching unit.

As an alternative to the illustrated flexographic printing units, gravure printing, offset printing, and rotary screen printing units can also be employed. At least one of the printing units 110 and/or the punching unit 150 shown herein have the construction of the processing units 10 described above.

The invention claimed is:

1. A processing unit for the rotational processing of a web-shaped or sheet-shaped substrate, the processing unit comprising:

a machine frame;

at least two processing cylinders including a first processing cylinder movably mounted in said machine frame, a second processing cylinder stationarily mounted in said machine frame, and pairs of support members each pair being associated with a respective one of said processing cylinders;

each respective support member associated with said second processing cylinder having a solid joint, a manipulator, and an annular segment being attached to said solid joint and contacting a respective one of said support members associated with said first processing cylinder; and each of said solid joints being linearly displaceable by a respective one of said manipulators and each of said annular segments being linearly displaceable with a respective one of said solid joints.

2. The processing unit according to claim 1, wherein each of said solid joints has one respective degree of freedom.

3. The processing unit according to claim 2, wherein each of said solid joints has at least one of elements or tapers in a material of said respective solid joint enabling an elastic deformation of said respective solid joint.

4. The processing unit according to claim 3, wherein each of said solid joints has a respective body and at least one respective leaf spring connecting said body to said machine frame.

5. The processing unit according to claim 1, wherein said manipulator is a rotatable eccentric roller or a helical roller being fixedly attached to said machine frame.

6. The processing unit according to claim 5, wherein said manipulator is rotatable by motive power.

7. The processing unit according to claim 1, wherein said support members associated with said first processing cylinder are raceways.

8. The processing unit according to claim 1, wherein said first processing cylinder has a tensioning mechanism for setting a relative position of said processing cylinders.

9. The processing unit according to claim 1, wherein said solid joint has a body, and said annular segment is disposed on said body so as to be pivotable counter to a restoring force.

10. A label printing machine, comprising at least one processing unit according to claim 1.

11. A label printing machine, comprising:

at least one processing unit according to claim 1;

said first processing cylinder being constructed as a printing cylinder;

said second processing cylinder being constructed as an impression cylinder; and a further stationary processing cylinder being constructed as an inking roller.

12. The label printing machine according to claim 11, wherein said inking roller is an anilox roller.

* * * * *